United States Patent [19]

List et al.

[11] 4,280,453

[45] Jul. 28, 1981

[54] MULTICYLINDER INTERNAL COMBUSTION ENGINE

[75] Inventors: Hans List, 126, Heinrichstrasse, Graz, Austria; Othmar Skatsche; Josef Greier, both of Graz, Austria

[73] Assignee: Hans List, Graz, Austria

[21] Appl. No.: 5,703

[22] Filed: Jan. 23, 1979

Related U.S. Application Data

[63] Continuation of Ser. No. 717,895, Aug. 26, 1976, abandoned.

[30] Foreign Application Priority Data

Sep. 4, 1975 [AT] Austria ..... 6850/75

[51] Int. Cl.[3] ..... F02F 7/00

[52] U.S. Cl. ..... 123/195 R; 123/195 C; 123/198 E; 123/195 A; 123/41.84

[58] Field of Search ..... 123/195 R, 195 A, 195 S, 123/195 H, 195 C, 198 E, 41.84, 41.83, 41.81, 41.72

[56] References Cited

U.S. PATENT DOCUMENTS

| | | | |
|---|---|---|---|
| 1,073,086 | 9/1913 | Blose | 123/198 E |
| 1,382,420 | 6/1921 | Fuller | 123/195 S |
| 1,420,684 | 6/1922 | Bradshaw | 123/195 A |
| 1,450,081 | 3/1923 | Henriod et al. | 123/195 R |
| 1,653,689 | 12/1927 | Angle | 123/195 A |
| 1,931,026 | 10/1933 | Lee | 123/195 R |
| 2,151,835 | 3/1939 | Bugatti | 123/195 R |
| 2,179,709 | 11/1939 | Brecht | 123/195 R |
| 2,759,470 | 8/1956 | Kremser | 123/195 A |
| 3,464,398 | 9/1969 | Scheiterlein et al. | 123/195 R |
| 3,674,000 | 7/1972 | Reisacher et al. | 123/41.84 |
| 3,841,203 | 10/1974 | Bruce | 123/195 H |

FOREIGN PATENT DOCUMENTS

| | | | |
|---|---|---|---|
| 544549 | 2/1956 | Belgium | 123/195 A |
| 392978 | 6/1933 | United Kingdom | 123/195 C |

*Primary Examiner*—Craig R. Feinberg

[57] ABSTRACT

A multicylinder internal combustion engine with a crankcase secured to a connection flange of the cylinder block and a flywheel at the output end of the crankshaft, the distance between the connection flange and the crankshaft axis corresponding approximately to half the diameter of the flywheel.

8 Claims, 3 Drawing Figures

MULTICYLINDER INTERNAL COMBUSTION ENGINE

This is a continuation of application Ser. No. 717,895 filed Aug. 26, 1976, now abandoned.

BACKGROUND OF THE INVENTION

1. Field of the Invention

This invention relates to a multicylinder, internal combustion engine of the kind comprising a crankcase secured to a connector flange of the cylinder block and a flywheel arranged at the output end of the crankshaft.

2. The Prior Art

In conventional multicylinder internal combustion engines the dividing plane between the cylinder block and the crankcase is usually situated approximately at the level of the crankshaft axis, and the flywheel housing is usually connected to the cylinder block and the crankcase by a plurality of bolts or screws which extend in a direction parallel to the crankshaft axis. The main bearings of the crankshaft are carried by the two-part, or divided, main bearing walls of the cylinder block and crankcase, or on brackets screwed or bolted to bearing bosses on the cylinder block. This conventional construction design involves comparatively heavy engine weights and a considerable outlay for the necessary casting technique and machining operations used. Furthermore, since engine torque is frictionally transmitted from the cylinder block to the flywheel housing, and in view of the small friction coefficient of about 0.1, numerous fastener bolts or screws of comparatively large cross section are needed on the flywheel flange. (Hereinafter, where the context admits, the term 'fastener' is deemed to include screws, bolts, studs or similar threaded elements).

Moreover, owing to the comparatively short distance between the dividing plane of the cylinder block and crankcase and the engine oil level, it is necessary to ensure an extremely careful seal along the connecting flanges of engine block and crankcase.

Finally, with these conventional engines there is also a very high degree of noise emission in the region of the crankshaft through or from the outer walls of the engine block. Consequently, the parts which are mounted on the engine block in the region of the crankshaft, e.g., the oil sump, the flywheel housing, etc., also have a very high level of resonance emission. Accordingly, these conventional combustion engines are also much in need of improvement with regard to noise emission, taken from the point of view of environmental protection.

It is the aim of the present invention to avoid the disadvantages appertaining to conventional constructions of a multicylinder internal combustion engine and to provide an engine of the kind specified which is primarily distinguished by its weight economy and reduced production outlay.

SUMMARY OF THE INVENTION

This invention relates to a multicylinder internal combustion engine with a crankcase secured to a connector flange of the cylinder block and a flywheel at the output end of the crankshaft, characterized in that the connector flange of the cylinder block is spaced away from the crankshaft axis by a distance corresponding approximately to half the diameter of the flywheel.

Preferably, the cylinder block is an integral casting with the cylinder head and carries the crankshaft bearings.

Such an arrangement, besides simplifying the cylinder block casting, achieves a considerable reduction in weight as compared with conventional cylinder block constructions wherein the connector flange is situated substantially at the level of the crankshaft axis. Since the crankcase is subject to the loads and stresses of engine torque and free forces mainly on the side of the flywheel and in the region of the front engine bearings only, it may be constructed of comparatively thin wall thickness with the result of further weight economy.

Apart from this, by positioning the connector flange in a plane which is situated above the flywheel, a large distance is created relative to the oil sump, thus obviating the sealing problems which frequently occur in conventional engines.

With an internal combustion engine according to this invention it is further possible to achieve a substantial reduction of noise emission because the connecting point of the crankcase, which comprises by far the largest noise-emitting surface, is now situated in a region of the cylinder block which is remote from the centers of noise-generation, and particularly from the crankshaft bearings.

Admittedly, Austrian Patent Specification No. 290 921, corresponding to U.S. Pat. No. 3,464,398 discloses a multicylinder internal combustion engine wherein the crankcase is replaced by an oil sump which has been extended upwardly beyond the middle of the crankshaft, and the crankshaft main bearings are arranged between bearing blocks projecting downwardly from the cylinder block and bearing brackets or stirrups secured thereon. However, this previously disclosed engine is an internal combustion engine specifically having a noise-inhibited cylinder block wherein the upwardly extended oil sump which constitutes part of the noise-suppressing casing, has no supporting or load-bearing functions whatsoever. For this reason it is not a casting but made of sheet metal or plastics material. Transmission of engine torque from the cylinder head to the flywheel housing is again obtained, in this previously described arrangement, by means of a plurality of fasteners spaced around the circumference of the flywheel flange and extend in a direction parallel to the crankshaft axis and which are engaged in threaded holes or bores provided in the cylinder block and a bridge which interconnects the bearing blocks of the crankshaft.

According to a preferred embodiment of this invention, the crankcase and the flywheel housing are produced as an integral casting and for the transmission of engine torque from the cylinder block to the flywheel case at least two fasteners are provided which pass through the connector flange near the flywheel case and wherein the axes cross or intersect the crankshaft axis at right angles. This integral design or execution of flywheel case and crankcase, which is made possible by the position of the connector flange above the flywheel, has the considerable advantage over the conventional fastener connection of the flywheel housing that almost the entire engine torque, of which the forces are effective in the axial direction of the mounting fasteners, is positively transmitted solely by these fasteners from the cylinder block to the flywheel case or clutch housing. Additionally, there is considerable simplification with regard to production costs resulting from the omission of the fasteners for the flywheel housing and the corresponding threaded holes or bores, and this arrangement also affords yet another considerable reduction in the overall weight of the engine.

In further development of the inventive idea, at least two further fasteners may be provided on the side of the cylinder block opposite the flywheel housing and pass through the connector flange with their axes intersecting or crossing the crankshaft axis at right angles. These additional fasteners serve to transmit the free forces from the cylinder block via the crankcase to the frontal engine supports. All other circumferentially spaced fasteners on the connector flange would then exclusively serve the purpose of providing an oil seal and could therefore be of much smaller or weaker dimensions.

In a water-cooled internal combustion engine it is furthermore highly advantageous, according to this invention, if the connector flange is formed as an integral casting of the cylinder block, joining the same in the region of the water-jacket. Numerous measurements and tests have proved that the resonance level of a water-cooled combustion engine is substantially lower in the region of the cylinder block cooling jacket than in the region of the crankshaft. By arranging the connector flange in this region of reduced noise emission it is also possible to achieve further reductions in body resonance emission from the exterior Zwalls of crankcase and flywheel housing.

A preferred example of execution of the invention will be more specifically hereinafter described with reference to the accompanying partly diagrammatic drawings.

DETAILED DESCRIPTION OF THE PREFERRED EMBODIMENTS

Figure 1:
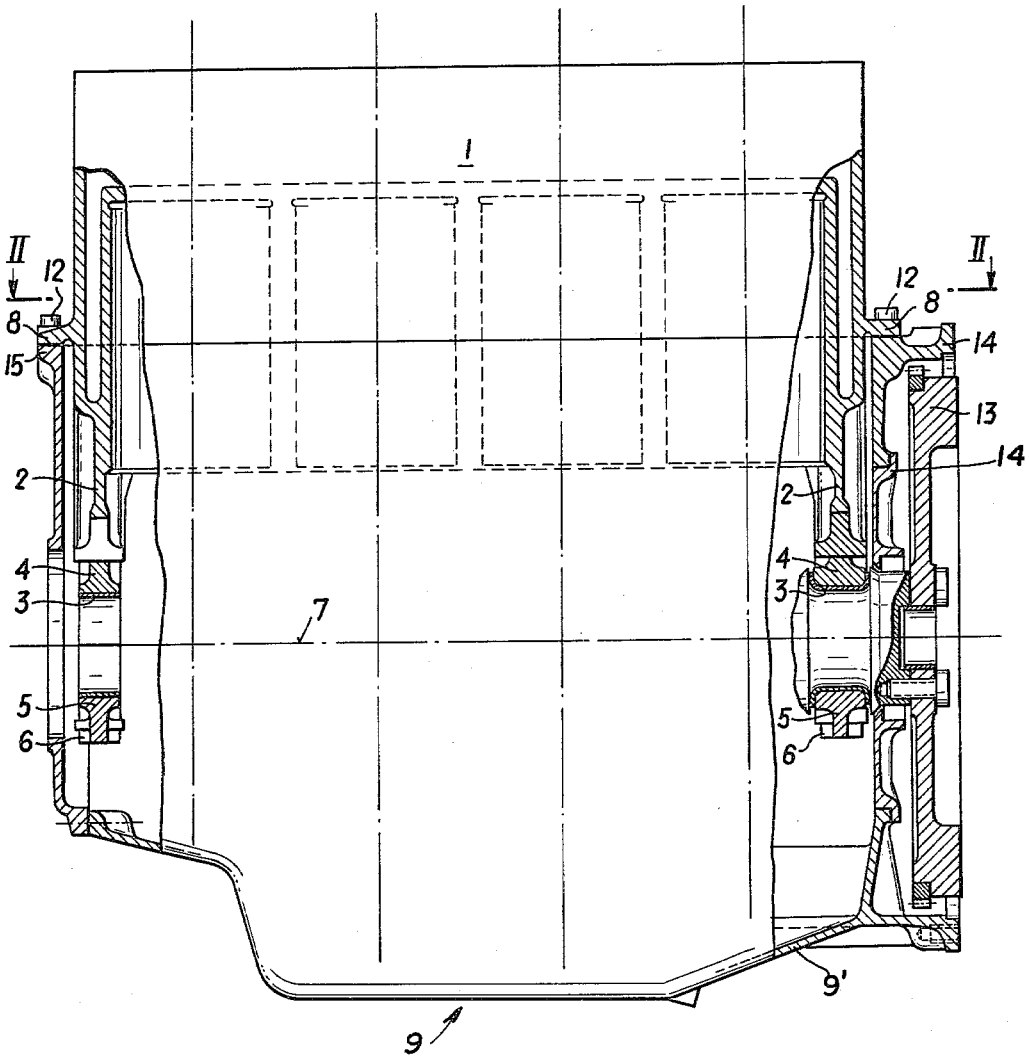
FIG. 1 is a side view of an internal combustion engine according to this invention, partly broken away.
Figure 2:
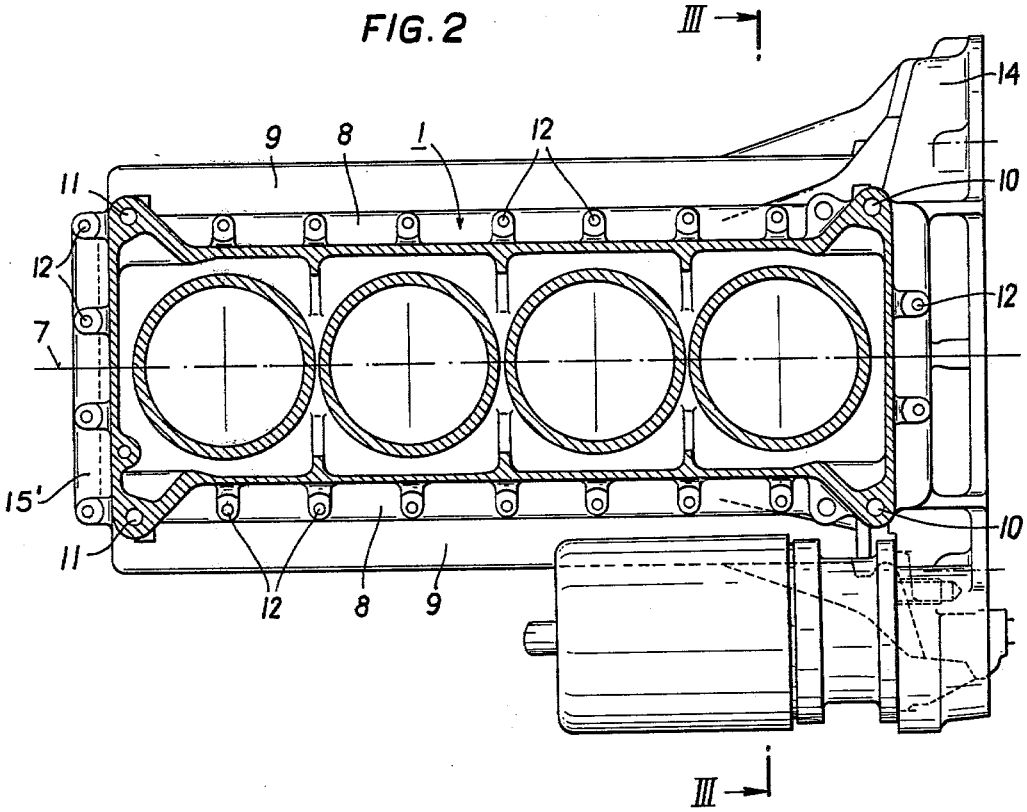
FIG. 2 is a horizontal section of the engine taken along the line II—II of FIG. 1.
Figure 3:
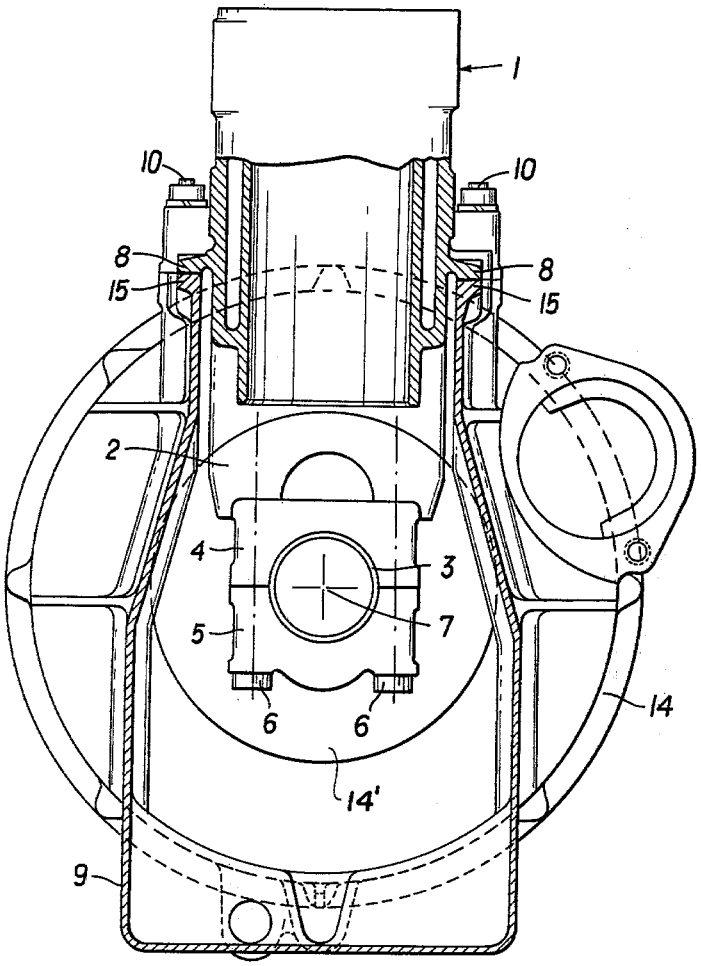
FIG. 3 is a front view of the engine taken along the section line III—III of FIG. 2.

The illustrated engine, whereof those parts which are not essential for the purposes of understanding the present invention are merely indicated in outline, is a water-cooled, aligned four-cylinder diesel engine of light-weight construction wherein a cylinder block 1 is an integral casting with the cylinder head and of substantially box-like outline. Crankshaft bearings 3 are mounted in two-part or divided bearing blocks 4, 5 secured by means of bolts 6 to the main bearing walls 2 which project downwardly from the cylinder block 1. The crankshaft (not shown) has an axis designated 7.

In the region of the cylinder water jacket, the cylinder block 1 comprises a circumferential connector flange 8 projecting from its exterior walls and to which is secured by means of bolts 10, 11 and 12, a crankcase generally designated 9 which in its lower portion also forms the oil sump. The crankcase 9 includes a body portion 9' as an integral casting with a flywheel housing 14 which contains a flywheel 13, an annular plate 14' which closes an opening in the crankcase at the flywheel side, a flywheel housing 14 and a forward cover plate 15'. The connector flange 8 of the cylinder block 1 is situated in a plane which is normal to the cylinder axes of the engine and spaced away from the crankshaft axis 7 by a distance which is at least equal to half the diameter of the flywheel 13. Accordingly, the upper securing flange 15 of plate 15' and the upper contour of the flywheel housing 14 are approximately at the same level.

In contrast with conventional combustion engines wherein the flywheel housing is secured to the cylinder block and to the crankcase by a plurality of bolts which are parallel with the crankshaft axis and consequently engine torque is transmitted to the flywheel housing by frictional engagement only, engine torque transmission in the combustion engine according to this invention occurs almost completely via the two comparatively heavily dimensioned bolts 10 arranged on the flywheel side. The axis of bolts lie in a plane perpendicular to a plane containing the crankshaft axis so as to extend in the direction of the forces created by engine torque. Consequently, engine torque is directly dynamically transmitted from the cylinder block 1 to the flywheel housing 14.

The two bolts 11, which are provided on the opposite end side of the engine and which have approximately the same dimensions as the bolts 10, serve to transmit the free forces from the cylinder block 1 via crankcase 9 to the front engine suspension (not shown).

The remaining bolts 12, which are regularly circumferentially spaced around the connector flange 8, serve exclusively to provide an oil seal between the cylinder block 1 and the crankcase 9. Consequently, they can be of much smaller dimensions and less strong than the bolts 10 and 11.

The high position of the connector flange 8 relative to the crankshaft axis 7, which is essential for the purposes of this invention, and the combination of the crankcase 9 and flywheel housing 14 in the form of a single integral casting, which is very favorable from the point of view of casting technique, not only present the earlier described advantages of direct transmission of engine torque and free forces, but also offer considerable acoustic advantages. Since the connector flange 8, which is arranged around the water jacket of the cylinder block 1, is situated in an area of comparatively little noise generation, it follows that only little body resonance is transmitted to the crankcase 9, with the result that noise radiation from the exterior walls of the crankcase 9 is very considerably reduced as compared with conventional engines wherein the dividing plane between the cylinder block and the crankcase is situated in the region of the crankshaft main bearings.

The elevated position of the connector flange 8 also presents further advantages with regard to the oil seal because the sealing face between the flanges 8 and 15 is far above the oil level in the crankcase 9.

I claim:

1. In a multicylinder internal combustion engine which includes a cylinder block, a crankcase positioned generally below the cylinder block, and a crankshaft extending through the crankcase and rotatable about a central axis; said cylinder block having a generally box-like shape and including integral main bearing means extending downwardly into said crankcase to support the crankshaft; and said crankcase having openings at opposite sides thereof through which the crankshaft extends; the improvements wherein said cylinder block includes a connection flange which extends outwardly along substantially all the sides of said cylinder block, said connection flange having a continuous surface which faces said crankcase, said crankcase includes a generally rectangular upper portion means which encompasses the portions of said cylinder block below the connection flange, a counter flange which extends outwardly along substantially all the sides of said upper portion means which is fixedly connected to all of said continuous surface of said connection flange of said cylinder block, and as an integral portion thereof a flywheel housing extending away from one side thereof, and said crankshaft includes at the end thereof which extends into said flywheel housing a flywheel, the radius of said flywheel being less than the distance between the connection flange of said cylinder block and said central rotational axis of said crankshaft.

2. The multicylinder internal combustion engine of claim 1 wherein said connection flange of said cylinder block includes a number of spaced part threaded holes along the length thereof, wherein said counter flange includes a number of spaced apart threaded holes along the length thereof in register with the holes in said connection flange, and wherein threaded bolt means are threaded in each of said registered holes to connect said crankcase with said cylinder block.

3. The multicylinder internal combustion engine of claim 2 wherein both said connection flange and said counter flange, at least in the corners thereof nearest the flywheel, are aligned in planes which are parallel to a horizontal plane passing through the crankshaft central rotational axis so as to improve transmissions of engine torque.

4. The multicylinder internal combustion engine of claim 2 wherein said cylinder block is formed so as to include a water jacket zone between the internal cylinder heads and the outer walls thereof, and wherein said connection flange is an integral part of said outer walls at a point along the depth of said water jacket zone.

5. The multicylinder internal combustion engine of claim 1 wherein said crankcase includes on the side thereof opposite the side nearest said flywheel housing a removable cover plate which, when removed, allows access to the inside of said crankcase.

6. The multicylinder internal combustion engine of claim 2 wherein said cylinder block includes means forming large-sized bolt holes therethrough near the opposite corners of the wall thereof nearest said flywheel, wherein said crankcase includes near said flywheel housing large-sized bolt holes therein in alignment with said large-sized bolt holes in said cylinder block, and wherein large-sized bolt holes in said cylinder block, and wherein large-sized bolts are threaded in said aligned large-sized holes, whereby the engine torque is transmitted from the cylinder block to the flywheel housing.

7. The multicylinder internal combustion engine of claim 6 wherein said cylinder block includes means forming additional large-sized bolt holes therethrough near the opposite corners of the wall thereof opposite said flywheel, wherein said crankcase includes on the side opposite said flywheel housing large-sized bolt holes therein in alignment with said additional large-sized bolt holes in said cylinder block, and wherein large-sized bolts are threaded in said aligned large-sized holes.

8. The multicylinder internal combustion engine of claim 7 wherein said large-sized hole means in both said cylinder block and said crankcase are so positioned that said large-sized bolts therein are aligned in a plane perpendicular to a horizontal plane passing through the crankshaft central rotational axis so as to enhance transmission of engine torque to the flywheel housing.

* * * * *